US006311850B1

(12) United States Patent
Friedrich et al.

(10) Patent No.: US 6,311,850 B1
(45) Date of Patent: Nov. 6, 2001

(54) PRESSURE SCREENING APPARATUS FOR SCREENING A PAPER STOCK SUSPENSION AND SCREEN CLEARER FOR SUCH A SCREENING APPARATUS

(75) Inventors: Hans Friedrich; Josef Bruckner, both of Heidenheim; Gerhard Veh, Höchstädt, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/527,015

(22) Filed: Mar. 16, 2000

(30) Foreign Application Priority Data

Mar. 17, 1999 (DE) ..... 199 11 884

(51) Int. Cl.[7] ..... D21D 5/02; D21D 5/06; B07B 1/20; B07B 1/24

(52) U.S. Cl. ..... 210/415; 210/394; 210/396; 210/397; 209/250; 209/273; 209/306; 209/304; 162/55; 162/251

(58) Field of Search ..... 210/415, 396, 210/394, 397, 403; 209/250, 273, 306, 303, 304; 162/55, 251

(56) References Cited

U.S. PATENT DOCUMENTS 3,363,759 * 1/1968 Clarke-Pounder .
3,400,820 * 9/1968 Nelson .
3,586,172 6/1971 Young .

(List continued on next page.)

FOREIGN PATENT DOCUMENTS

3240487 * 5/1984 (DE) .
4432842 3/1996 (DE) .
0289020 11/1988 (EP) .
0629738 12/1994 (EP) .

(List continued on next page.)

OTHER PUBLICATIONS

An English Language abstract of DE 44 32 842.

(List continued on next page.)

*Primary Examiner*—Thomas M. Lithgow
(74) *Attorney, Agent, or Firm*—Greenblum & Bernstein, P.L.C.

(57) ABSTRACT

A pressure screening apparatus for screening a stock suspension and screen clearer for a pressure screening apparatus. The pressure screening apparatus includes an inflow chamber, a suspension inflow connected to one end of the inflow chamber, a reject outflow connected to another end of the inflow chamber, an accepted stock chamber, an acceptance stock pipe connected to the accepted stock chamber, at least one screen element disposed between the inflow chamber and the accepted stock chamber, a screen clearer adapted to move with respect to the at least one screen element for preventing clogging of the at least one screen element, the screen clearer comprising at least a first clearing zone and at least a second clearing zone, the first clearing zone having a plurality of clearing elements and the second clearing zone having a plurality of clearing elements which are different from those of the first clearing zone, wherein the stock suspension flows into the pressure screening apparatus via the suspension inflow such that a portion of the stock suspension flows through the clearing zones and exits the pressure screening apparatus through the reject outflow. The screen clearer includes a substantially cylindrical body having a cylindrical outer surface. The cylindrical outer surface includes at least a first clearing zone and at least a second clearing zone. The first clearing zone has a plurality of clearing elements. The second clearing zone has a plurality of clearing elements which are different from those of the first clearing zone. The cylindrical body is rotatably mountable.

67 Claims, 3 Drawing Sheets

U.S. PATENT DOCUMENTS

| | | | |
|---|---|---|---|
| 3,726,401 | * | 4/1973 | Bolton, III et al. . |
| 4,356,085 | * | 10/1982 | Schon et al. . |
| 5,000,842 | | 3/1991 | Ljokkoi . |
| 5,045,183 | * | 9/1991 | Schweiss et al. . |
| 5,096,127 | * | 3/1992 | Young . |
| 5,147,543 | * | 9/1992 | Frejborg . |
| 5,224,603 | * | 7/1993 | Hanana et al. . |
| 5,476,178 | | 12/1995 | Lamort . |
| 5,547,083 | | 8/1996 | Alajääski et al. . |

FOREIGN PATENT DOCUMENTS

| | | |
|---|---|---|
| 2006311 | 4/1969 | (FR) . |
| 93/22494 | 11/1993 | (WO) . |
| 98/53135 | 11/1998 | (WO) . |

OTHER PUBLICATIONS

Scientific Article by R. Reinecker: "Sortierung– ein Werkzeug zur Sticky–Entfernung: Maschinen [Grading—A Tool for Sticky Removal: Machines]" (Wochenblatt für papierfabrikation [Paper Manufacturing Weekly], No. 17, 1997, pp. 787 to 793).

Scientific Article by R. Rienecker: "Sortierung– ein Werkzeug zur Sticky–Entfernung: Systeme [Grading—A Tool for Sticky Removal: System]" (Wochenblatt für Papierfabrikation [Paper Manufacturing Weekly], No. 18, 1997, pp. 855–859).

* cited by examiner

PRESSURE SCREENING APPARATUS FOR SCREENING A PAPER STOCK SUSPENSION AND SCREEN CLEARER FOR SUCH A SCREENING APPARATUS

CROSS-REFERENCE TO RELATED APPLICATIONS

The present application claims priority under 35 U.S.C. §119 of German Patent Application No. 199 11 884.1, filed on Mar. 17, 1999, the disclosure of which is expressly incorporated by reference herein in its entirety.

BACKGROUND OF THE INVENTION

1. Field of the Invention

The invention relates to a pressure screening apparatus for screening a stock suspension and to a screen clearer.

2. Discussion of Background Information

Pressure screening apparatuses are typically used in treating paper stock suspensions, in order to process the stock suspension in a wet screening. For this purpose, the pressure screening apparatus contains a screen element which includes a number of apertures. The fibers contained in the suspension are allowed to pass through these apertures, while the undesired solid components of the suspension are prevented from doing so and are rejected and conducted out of the screening apparatus. This device may also be use for separating various grades of fiber components, i.e., separating the shorter fibers from longer fibers. Such screening apparatuses typically use round holes or slits as the grading apertures. In most cases, pressure screening apparatuses of the type under consideration here also utilize screen clearers which have clearing surfaces that are moved past the screen. This conventional design is intended to prevent clogging of the screen apertures.

A screen clearer is known from WO 98/53135 which utilizes blade elements to clear the screen. These blade elements have a hydrodynamic profile which extends over the entire length of the screen element. This design also utilizes a revolving screen. Owing to their movement relative to the surrounding suspension, the blade elements exert a pressure impulse in front of the screen and a suction impulse behind the screen. This design causes part of the suspension which was rejected at the screen or part of the suspension which has already passed the screen as accepted stock, to be sucked back. As a result of this design, the screen apertures are kept clear or are cleared. In order to effectively process suspensions having different solid contents ("consistency") in different zones of the screen element, the cross sections of the blade elements are shaped differently. However, the ability of this design to efficiently screen the stock suspension is very limited.

U.S. Pat. No. 3,586,172 discloses a pressure screening apparatus whose rotor is divided into four different zones. After a first zone, which serves only to accelerate the material, the suspension reaches a grading zone in which the rotor is equipped with elevations which are intended to fluidize the stock suspension and prevent the formation of fiber flocks ("dusters"). The subsequent grading zone is similar to the first zone and has depressions in the rotor which are intended to ensure that the flow speed is maintained and thus to prevent clogs ("plugging"). However, the clearing effect of such depressions in this design is poor.

In EP 0 289 020, it is suggested to prevent or to reduce the too rapid deckering of the residue by utilizing a rotor which accelerates the axial transport along the revolving screen.

For this purpose, the rotor has a number of projections ("bulges") with oblique surfaces which produce axial flow components. Depending on the axial position of the projection in question, axial impulses of different strengths are thus produced.

SUMMARY OF THE INVENTION

The invention therefore provides a pressure screening apparatus which utilizes a special screen clearer acting on the entire screen element. The design promotes a good grading effect and is particularly robust or sturdy so as to withstand forces which are encountered in continuous use. It also enables a high throughput, and is moreover suitable for suspensions whose consistency is above 2% as well.

The invention includes a screen clearer which is provided with a number of clearing elements that differ depending on their position. While the actual shape of the clearing elements used is known per se from prior art, their combination in the manner shown is unknown and results in considerable advantages. The invention provides that in the course of the transport flow of the stock suspension, the suspension travels along the screen element. Further, the screen clearing is carried out with increasing clearing effect as the suspension travels within the screening apparatus. The suspension is acted upon by various clearing element configurations, until the portions of the suspension which did not pass through the screen element leave the apparatus via the reject outflow. In order to provide a grading effect on the suspension, it should be noted that both the size and shape of the grading apertures in the screen element as well as the shape of the clearing elements which keep the screen element clear are important. Moreover, the clearing elements produce pressure and suction impulses at the screen apertures, with the suction impulses serving to accomplish the clearing, i.e., keeping the screen clear.

The invention uses various combinations of clearing elements in which distinctions can be drawn between several types of these clearing elements whose construction is fundamentally different. Thus, one type of clearing element is in the form of hydrodynamically effective blades around which the suspension flows. These can be moved relative to the suspension in the intermediate space between the rotor and the screen element. As a result of this design, pressure and suction phenomena specifically occurs which promotes throughput efficiency. Another type of clearing element utilizes mounted elevations which are essentially in the form of spherical segments or "bumps". These are disposed on a rotor body. Another clearing element design utilizes mounted elevations which have a more or less pronounced wedge shape. Still another clearing element design uses the rotor body itself which has a particular shape. This shape may have an oval configuration or may have the form or shape of a rounded polygon, e.g., a triangle or a lobed rotor.

The effect that the various clearing elements have on grading characteristics and the throughput of the suspension is described for example in the scientific article by R. Rienecker: "Sortierung—ein Werkzeug zur Sticky-Entfernung: Maschinen [Grading—A Tool for Sticky Removal: Machines]" (Wochenblatt für Papierfabrikation [Paper Manufacturing Weekly], Nos. 17 and 18, 1997, pp. 787 to 793, 855 to 859), the disclosure of which is expressly incorporated by reference in its entirety. These possible configurations described based on cleared revolving screens also exist, of course, for screen clearers intended to keep flat screens clear.

With the rotor of the pressure screening apparatus according to the invention, the different clearing elements can be arranged such that the screen clearing effect in different clearing zones is increased during the course of the transport flow. Initially, the paper stock suspension is relatively thin immediately after entry into the pressure screening apparatus and has a high content of accepted stock and fillers. Thus, the demands on the screen clearing are lower at this point than during the later course. As a general rule, a decreased clearing effect serves to improve the grading quality, i.e., the separation efficiency. Thus, more fibers reach the accepted stock. In contrast, if too much of the accepted stock and fillers were to flow through the screen in this first zone, they would not be present as wet and support material in the subsequent grading zones. By utilizing the invention, the grading effect can be evened out so that a favorable mixture of fibers and accepted stock is present in larger areas of the screening apparatus. This is important for "saving" the long fibers, which would otherwise be too readily rejected permanently, i.e., would reach the reject outflow of the pressure screening apparatus.

The tendency to force substances through in the transport direction can also be increased with the invention. For example, the separation boundary between the rejected and accepted portions at a screen element can be shifted as the clearing effect increases. As a result, portions which are held back when the force-through tendency is weaker, are allowed to pass through when the tendency is stronger. In this connection, it is favorable for the clearing elements which have a high force-through tendency, e.g., those with wedge-shaped elevations or triangular contours, to be utilized only in a small area of the revolving screen. As a result, the achievable advantages greatly outweigh the disadvantages. Moreover, such configurations are themselves more particularly strong or robust when exposed to the flow forces. Moreover, such configurations, for their part, cause only a small load by alternate bending stresses at this particularly endangered point of the screen element. It may also be advisable to connect the increasing clearing effect with a falling force-through tendency, such as when too much dirt accumulates in the downstream clearing zones.

It can be advantageous for the screen clearer to have a modular construction. In such a design the screen clearer can utilize several parts or sections which are detachably coupled together, each of which e.g., forms a clearing zone. Thus, clearing zones can be combined in a suitable and interchangeable manner. Moreover, this design allows for matching the screening apparatus to a specific application, e.g., by changing the sequence of clearing zones. Additionally, this design allows the worn-out parts to be exchanged more easily.

It is also possible to combine the configuration of the screen clearer of the invention described above with a specific characteristic of the screen element. For example, a screen element can be provided with screen apertures that decrease in size continuously or stepwise in the direction of transport as described in DE 44 32 842, the disclosure of which is expressly incorporated by reference it its entirety. This design takes into account the dirt load which increases during the passage through the screening apparatus. Optimum grading quality, high throughput, and operating safety can be combined in this manner.

According to one aspect of the invention there is provided a pressure screening apparatus for screening a stock suspension including an inflow chamber, a suspension inflow connected to one end of the inflow chamber, a reject outflow connected to another end of the inflow chamber, an accepted stock chamber, an acceptance stock pipe connected to the accepted stock chamber, at least one screen element disposed between the inflow chamber and the accepted stock chamber, a screen clearer adapted to move with respect to the at least one screen element for preventing clogging of the at least one screen element, the screen clearer comprising at least a first clearing zone for producing a first clearing effect and at least a second clearing zone for producing a second clearing effect, the first clearing effect being different from the second clearing effect, wherein the stock suspension flows into the inflow chamber via the suspension inflow such that a portion of the stock suspension flows through the clearing zones and exits through the reject outflow. The at least one screen can separate the inflow chamber from the accepted stock chamber. The first clearing zone can include a plurality of elements and the second clearing zone can include a plurality of elements. The plurality of elements of the first clearing zone can have a shape which is different from the plurality of elements of the second clearing zone. The second clearing zone can produce a clearing effect which is greater than the first clearing zone. The second clearing zone can produce a greater flow resistance than the first clearing zone.

The first clearing zone may include a plurality of elements and the second clearing zone may include a plurality of elements, the plurality of clearing elements of the second zone being different from those of the first clearing zone by one of geometric shape and type of element. The plurality of clearing elements of the first clearing zone may differ from the plurality of clearing elements of the second clearing zone by each of geometric shape and type of element. The first clearing zone may include a plurality of clearing elements, the clearing elements being one of partially spherical segments and substantially spherical segments. The plurality of clearing elements of the first zone may be fixed to a surface of the screen clearer.

The surface of screen clearer may rotate with respect to the at least one screen element. The second clearing zone may be axially separated from the first clearing zone. One of the first clearing zone and the second clearing zone may include a plurality of clearing elements in the form of hydrodynamic flow profiles. The hydrodynamic flow profiles may be fixed to a surface of the screen clearer. The hydrodynamic flow profiles may be fixed to a surface of the screen clearer such that they are separated from the surface by a radial distance. The surface of the screen clearer may rotate with respect to the at least one screen element. One of the first clearing zone and the second clearing zone may include a plurality of clearing elements in the form of wedge-shaped elevations. The wedge-shaped elevations may be fixed to a surface of the screen clearer.

The surface of the screen clearer may rotate with respect to the at least one screen element. The at least one screen element may be cylindrical. One of the first clearing zone and the second clearing zone may include clearing elements in the form of at least two lobes. One of the first clearing zone and the second clearing zone may include clearing elements in the form of at least two lobes of a rounded polygon. The at least two lobes may rotate with respect to the at least one screen element. The rounded polygon may rotate with respect to the at least one screen element. The rounded polygon may include at least two segments which are fixed to the screen clearer.

A force-through tendency of the second clearing zone may be greater than a force-through tendency of the first clearing zone. The suspension may travel from the first clearing zone to the second clearing zone in a transport flow path. The first clearing zone may include a plurality of clearing elements in the form of substantially spherical segments, the first clearing zone being disposed adjacent the suspension inflow. The second clearing zone may include a plurality of clearing elements in the form of hydrodynamic flow profiles, the second clearing zone being disposed adjacent the first clearing zone.

The pressure may further include a third clearing zone disposed adjacent the second clearing zone, wherein the third clearing zone is arranged to produce a different clearing effect than the first and second clearing zones. The third clearing zone may include a plurality of clearing elements in the form of wedge-shaped elevations.

The pressure screening apparatus may further include a fourth clearing zone disposed adjacent the third clearing zone, wherein the fourth clearing zone is arranged to produce a different clearing effect than the first, second, and third clearing zones. The fourth clearing zone may include a polygon having at least two lobes. The fourth clearing zone may be disposed adjacent the reject outflow. The clearing effect may be increased from the first clearing zone disposed adjacent the suspension inflow to the fourth clearing zone disposed adjacent the reject outflow. The at least one screen element comprises a plurality of apertures of varying sizes. The apertures adjacent the first clearing zone may be greater in size than the apertures adjacent the second clearing zone. The at least one screen element may include one of apertures and slots and slits. The at least one screen element may include slots. The slots adjacent the first zone may have a width which is greater than the slots adjacent the second zone. The at least one screen element may include round holes, such that the round holes adjacent the first clearing zone have a greater diameter than the round holes which are adjacent the second clearing zone. The at least one screen clearer may include at least two modular sections which are detachably coupled together. The at least one modular section may include one of the first clearing zone and the second clearing zone.

The first zone may include a modular section and the second zone comprises a modular section. The modular sections may be interchangeable. The pressure screening apparatus may further include at least one intermediate zone disposed between the first clearing zone and the second clearing zone, wherein each of the first, the second, and the at least one intermediate zones, include a modular section.

According to another aspect of the invention there is provided a screen clearer for a pressure screening apparatus which includes a substantially cylindrical body having a cylindrical outer surface, the cylindrical outer surface including at least a first clearing zone and at least a second clearing zone, the first clearing zone having a plurality of clearing elements and the second clearing zone having a plurality of clearing elements which are different from those of the first clearing zone, wherein the cylindrical body is rotatably mountable. One of the first clearing zone and the second clearing zone may include a plurality of clearing elements in the form of substantially spherical segments. One of the first clearing zone and the second clearing zone may include a plurality of clearing elements in the form of hydrodynamic flow profiles. The first clearing zone may include a plurality of clearing elements in the form of hydrodynamic flow profiles and the second clearing zone may include a plurality of clearing elements in the form of wedge-shaped elevations.

The first clearing zone may include a modular section which is detachably coupled to the second clearing zone. Each of the first clearing zone and the second clearing zone may be a modular section which are detachably coupled to each other. The first clearing zone may include a plurality of clearing elements in the form of hydrodynamic flow profiles and the second clearing zone comprises a plurality of clearing elements in the form of wedge-shaped elevations. The first clearing zone may include a modular section which is detachably coupled to the second clearing zone. Each of the first clearing zone and the second clearing zone may include a modular section which are detachably coupled to each other. The screen clearer may further include a third clearing zone disposed adjacent the second clearing zone, the third clearing zone comprising a plurality of clearing elements which are different from those of the first clearing zone and the second clearing zone. Each of the first clearing zone, the second clearing zone, and the third clearing zone may include a modular section which are detachably coupled to each other. The first clearing zone may include a plurality of clearing elements in the form of substantially spherical segments, the second clearing zone comprises a plurality of clearing elements in the form of hydrodynamic flow profiles, and the third clearing zone comprises a plurality of clearing elements in the form of wedge-shaped elevations. The screen clearer may further include a third clearing zone disposed adjacent the second clearing zone and a fourth clearing zone disposed adjacent the third clearing zone, wherein the third clearing zone comprising a plurality of clearing elements which are different from those of the first clearing zone and the second clearing zone and wherein the forth clearing zone comprising a plurality of clearing elements which are different from those of the first, second, and third clearing zones. Each of the first clearing zone, the second clearing zone, the third clearing zone, and the fourth clearing zone may include a modular sections which are detachably coupled to each other.

The first clearing zone may include a plurality of clearing elements in the form of substantially spherical segments, the second clearing zone may include a plurality of clearing elements in the form of hydrodynamic flow profiles, the third clearing zone may include a plurality of clearing elements in the form of wedge-shaped elevations and the forth clearing zone may include one of a lobed rotor and rotating polygon having at least two lobes.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
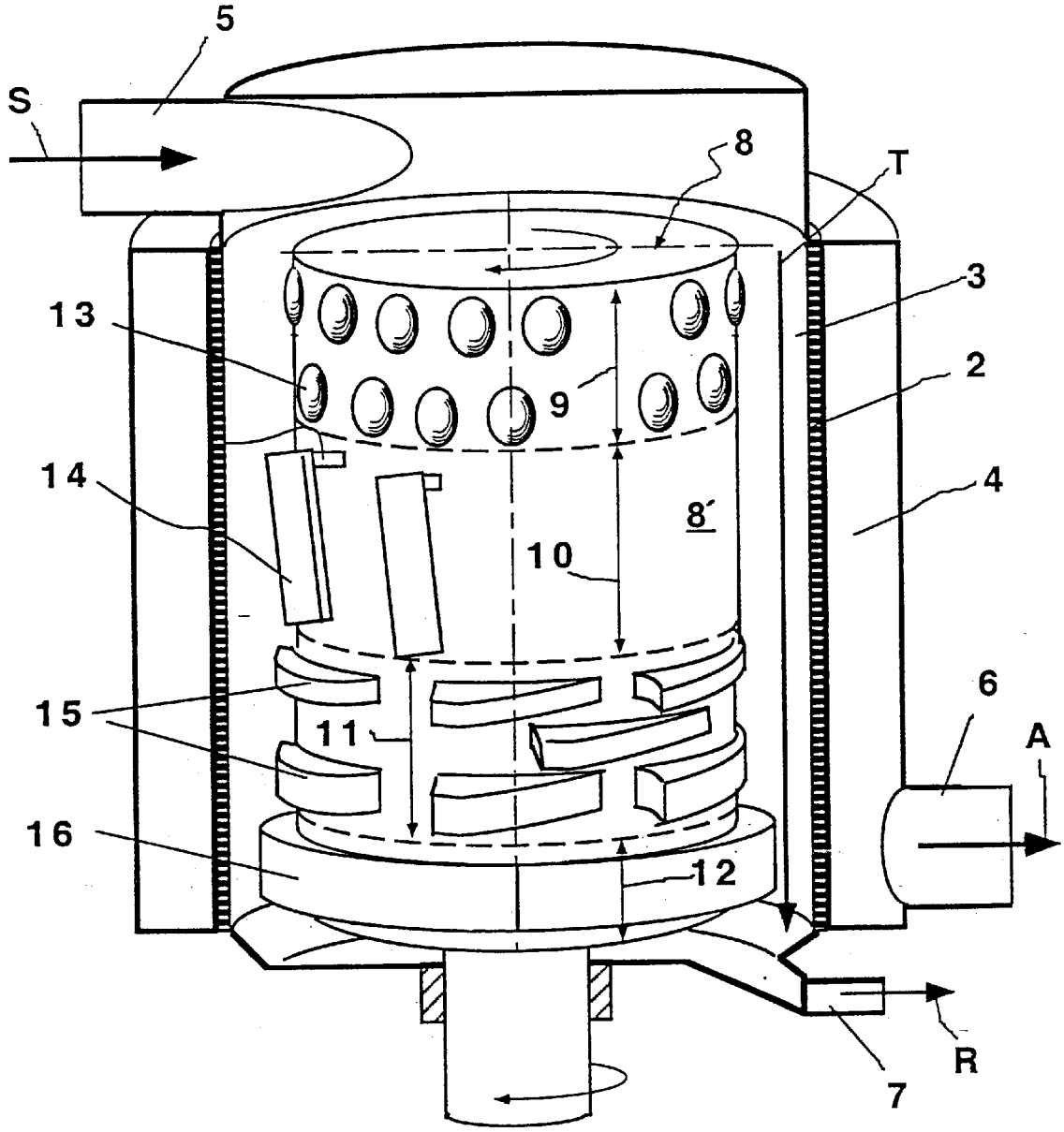
FIG. 1 shows one embodiment of the invention in schematic, perspective representation.

FIG. 1 shows a pressure screening apparatus according to the invention having a screen element 2, here in the form of a revolving cylindrical screen, that divides the inner chamber of the pressure screening apparatus into an inflow chamber 3 and an accepted stock chamber 4. Stock suspension S can be fed into inflow chamber 3 via a suspension inflow 5. In the pressure screening apparatus used here, suspension S receives a rotation impulse that displaces it in a circumferential movement. In addition, a transport flow T, symbolized by an arrow pointing vertically downwards, is produced as a result of the applied pressure gradient between suspension inflow 5 shown above and reject outflow 7 lying below. On the path of transport flow T, a large part of stock suspension S is led off through screen element 2 into accepted stock chamber 4 as specified. At least a large part of the paper fibers contained in stock suspension S also pass into accepted stock chamber 4. In order to prevent the apertures of screen element 2 from becoming clogged, a screen clearer 8, is used which can be moved relative to screen element 2. According to the invention, clearing elements 13, 14, 15, and 16 used on screen clearer 8 are formed so that, seen in the direction of transport flow T, several clearing zones 9, 10, 11, and 12 are formed, each of which has different clearing elements 13, 14, 15 and 16 respectively. Screen clearer 8 of the embodiment shown here contains a total of four different clearing zones, with a first clearing zone 9 being provided with partially or substantially spherical segments 13, a second clearing zone 10 having hydrodynamic flow profiles 14, a third clearing zone 11 having wedge-shaped elevations 15, and a last or fourth clearing zone 12 which includes a rotating polygon or lobed rotor 16. Although the sequence shown here is indeed particularly advantageous in many cases, this is not the only configuration contemplated by the invention. The number of clearing zones and their configuration, for example, can be varied. It is important for the clearing effect exerted by the clearing elements to be increased from first stage to last stage or first zone to last zone. A relatively high throughput through the pressure screening apparatus is then possible, since this design creates an increasing resistances on the path of the transport flow T. Moreover, this design balances out as the passage of the suspension through the screen element since it is assisted by a correspondingly stronger effectiveness of clearing elements 13, 14, 14, and 16.

Figure 2:
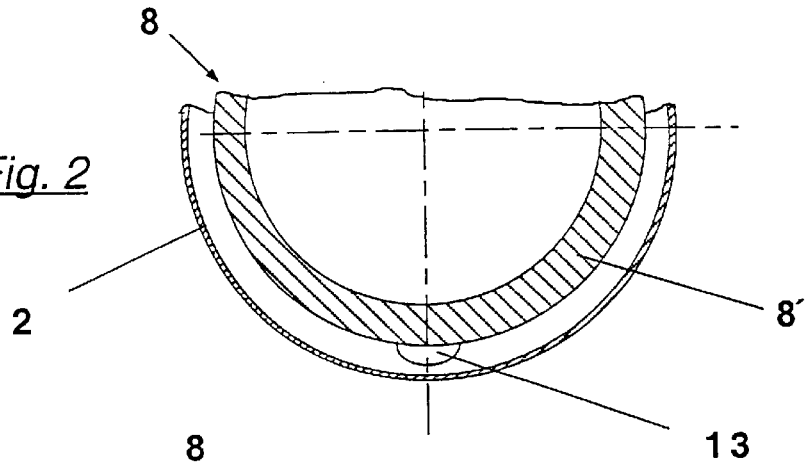
FIGS. 2–5 each show a cross-sectional top view through various configurations of the clearing elements mounted on the rotor.

FIG. 2 shows in schematic representation a top view of a clearing zone configuration in which bumps or substantially spherical or partially spherical segments 13 are mounted directly on a rotor 8'. It should be noted that these spherical segments exert less of an influence on suspension S and have a relatively low circumferential speed than some of the other clearing elements designs. Their reduced clearing effect at this stage of the screening apparatus is facilitated by this design.

Figure 3:
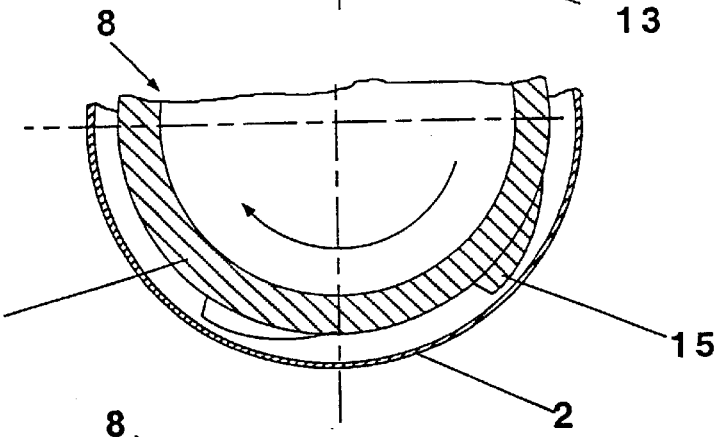

FIG. 3 shows another variation of a clearing zone design which utilizes wedge-shaped elevations 15 which are likewise fixed on rotor 8'. Moreover, this design leaves little or no gap between elevations 15 and screen element 2.

Figure 4:
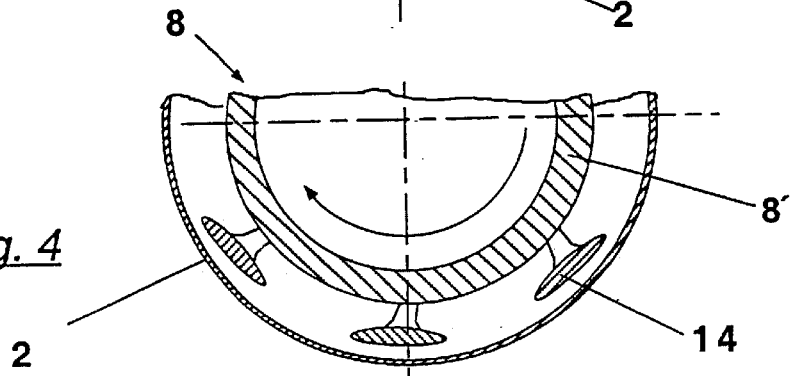

FIG. 4 shows another variation of a clearing zone configuration which utilizes hydrodynamic flow profiles 14 which are fixed on rotor 8' of screen clearer 8.

Moreover, profiles 14 have end blades which are oriented at a radial distance from a surface of screen clearer 8. Although, only one particular shape of such a hydrodynamic flow profile design is shown here, the invention contemplates the use of other conventional shapes and designs. These may even include, for example, blades having a greater length in the circumferential direction.

Figure 5:
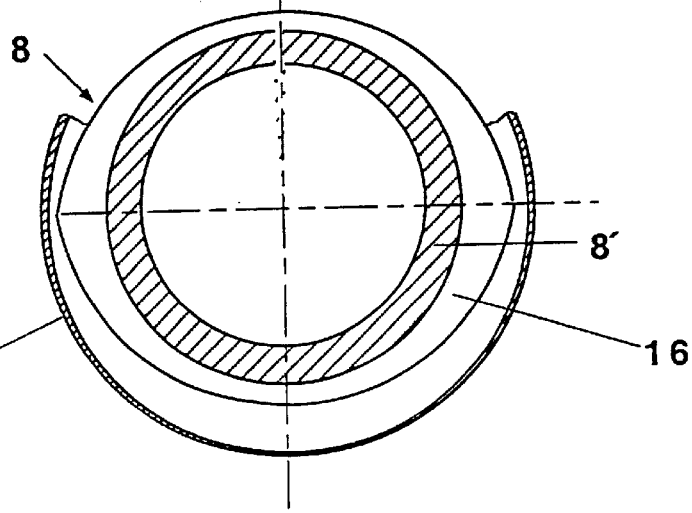

FIG. 5 shows as a further variant of clearing zone design which uses a so-called "lobed rotor". This design incorporates a rounded polygon 16 which can be, for example, formed of two cylinder segments, each of which has an ellipse section as its base. The transition point of adjacent cylinder segments may be discontinuous on the outer contour as is shown.

Figure 6:
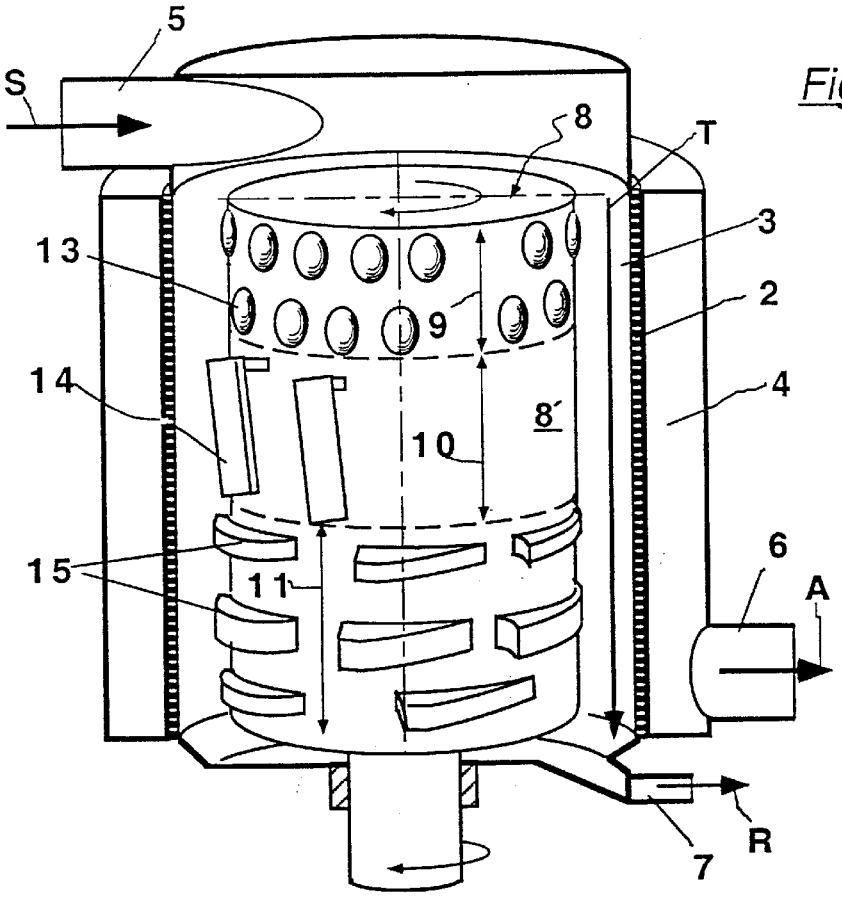
FIG. 6 shows another embodiment which utilizes three clearing zones.

The pressure screening apparatus shown in FIG. 1 utilizes a complex design of multiple stages or zones. In fact, it has four different clearing zones 9, 10, 11, and 12. However, the invention contemplates the use of more stages in some cases and in many cases the use of fewer. Thus, FIG. 6 shows an example of a screening apparatus which utilizes only three different clearing zones 9, 10, and 11. This design can achieve an increasing clearing effect in the direction of transport flow T as well.

Figure 7:
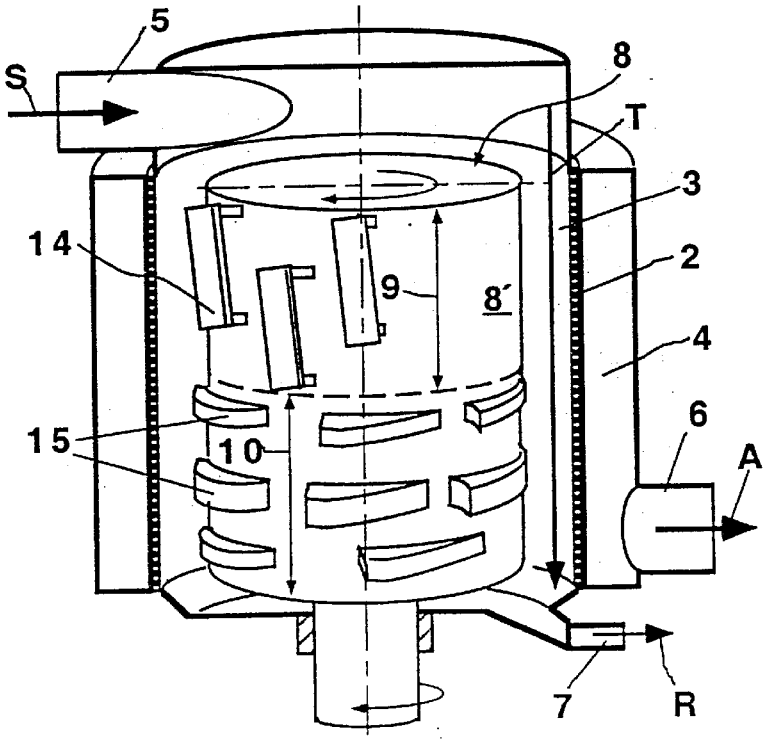
FIG. 7 shows another embodiment which utilizes two clearing zones.

The invention also contemplates an even simpler two stage design such as the embodiment shown in FIG. 7. Moreover, this design or configuration can also be used to completely fulfill the technical requirements desired. In this embodiment, screen clearer 8 utilizes hydrodynamic flow profiles 14 in first clearing zone 9 and wedge-shaped elevations 15 in second clearing zone 10. In many applications, this embodiment can be a technical and economic optimum of the invention.

As can be seen from the various embodiments many types of possible configurations are possible. The number of zones and their particular configuration can be varied to optimize the desired efficiency or effect of the screening apparatus. However, the best results are achieved when the clearing effect is increased from stage to stage or zone to zone, as a result of increasing the resistance of transport flow T using various clearing element configurations.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A pressure screening apparatus for screening a stock suspension comprising:

an inflow chamber;

a suspension inflow connected to one end of the inflow chamber;

a reject outflow connected to another end of the inflow chamber;

an accepted stock chamber;

an acceptance stock pipe connected to the accepted stock chamber;

at least one screen element disposed between the inflow chamber and the accepted stock chamber;

a screen clearer adapted to move with respect to the at least one screen element for preventing clogging of the at least one screen element;

the screen clearer comprising at least a first clearing zone for producing a first clearing effect and at least a second clearing zone for producing a second clearing effect, the first clearing effect being different from the second clearing effect, wherein the stock suspension flows into the inflow chamber via the suspension inflow such that a portion of the stock suspension flows through the clearing zones and exits through the reject outflow, wherein the at least one screen clearer comprises at least two modular sections which are detachably coupled together.

2. The pressure screening apparatus of claim 1, wherein at least one modular section comprises one of the first clearing zone and the second clearing zone.

3. The pressure screening apparatus of claim 2, wherein the first zone comprises a modular section and the second zone comprises a modular section.

4. The pressure screening apparatus of claim 3, wherein the modular sections are interchangeable.

5. The pressure screening apparatus of claim 4, further comprising at least one intermediate zone disposed between the first clearing zone and the second clearing zone, wherein each of the first, the second, and the at least one intermediate zones, comprise a modular section.

6. A screen clearer for a pressure screening apparatus comprising:

a substantially cylindrical body having a cylindrical outer surface;

the cylindrical outer surface comprising at least a first clearing zone and at least a second clearing zone, the first clearing zone having a plurality of clearing elements and the second clearing zone having a plurality of clearing elements which are different from those of the first clearing zone, wherein the cylindrical body is rotatably mountable, wherein one of the first clearing zone and the second clearing zone comprises a plurality of clearing elements in the form of hydrodynamic flow profiles, and wherein the first clearing zone comprises a modular section which is detachably coupled to the second clearing zone.

7. A screen clearer for a pressure screening apparatus comprising:

a substantially cylindrical body having a cylindrical outer surface;

the cylindrical outer surface comprising at least a first clearing zone and at least a second clearing zone, the first clearing zone having a plurality of clearing elements and the second clearing zone having a plurality of clearing elements which are different from those of the first clearing zone, wherein the cylindrical body is rotatably mountable, wherein one of the first clearing zone and the second clearing zone comprises a plurality of clearing elements in the form of hydrodynamic flow profiles, and wherein each of the first clearing zone and the second clearing zone comprises a modular section which are detachably coupled to each other.

8. A screen clearer for a pressure screening apparatus comprising:

a substantially cylindrical body having a cylindrical outer surface;

the cylindrical outer surface comprising at least a first clearing zone and at least a second clearing zone, the first clearing zone having a plurality of clearing elements and the second clearing zone having a plurality of clearing elements which are different from those of the first clearing zone, wherein the cylindrical body is rotatably mountable, wherein the first clearing zone comprises a plurality of clearing elements in the form of hydrodynamic flow profiles and the second clearing zone comprises a plurality of clearing elements in the form of wedge-shaped elevations, and wherein the first clearing zone comprises a modular section which is detachably coupled to the second clearing zone.

9. A screen clearer for a pressure screening apparatus comprising:

a substantially cylindrical body having a cylindrical outer surface;

the cylindrical outer surface comprising at least a first clearing zone and at least a second clearing zone, the first clearing zone having a plurality of clearing elements and the second clearing zone having a plurality of clearing elements which are different from those of the first clearing zone, wherein the cylindrical body is rotatably mountable, wherein the first clearing zone comprises a plurality of clearing elements in the form of hydrodynamic flow profiles and the second clearing zone comprises a plurality of clearing elements in the form of wedge-shaped elevations, and wherein each of the first clearing zone and the second clearing zone comprises a modular section which are detachably coupled to each other.

10. A screen clearer for a pressure screening apparatus comprising:

a substantially cylindrical body having a cylindrical outer surface;

the cylindrical outer surface comprising at least a first clearing zone and at least a second clearing zone, the first clearing zone having a plurality of clearing elements and the second clearing zone having a plurality of clearing elements which are different from those of the first clearing zone, a third clearing zone disposed adjacent the second clearing zone, the third clearing zone comprising a plurality of clearing elements which are different from those of the first clearing zone and the second clearing zone, wherein the cylindrical body is rotatably mountable, and wherein each of the first clearing zone, the second clearing zone, and the third clearing zone comprises a modular section which are detachably coupled to each other.

11. A screen clearer for a pressure screening apparatus comprising:

a substantially cylindrical body having a cylindrical outer surface;

the cylindrical outer surface comprising at least a first clearing zone and at least a second clearing zone, the first clearing zone having a plurality of clearing elements and the second clearing zone having a plurality of clearing elements which are different from those of the first clearing zone, a third clearing zone disposed adjacent the second clearing zone, the third clearing zone comprising a plurality of clearing elements which are different from those of the first clearing zone and the second clearing zone, wherein the cylindrical body is rotatably mountable, and wherein the first clearing zone comprises a plurality of clearing elements in the form of substantially spherical segments, the second clearing zone comprises a plurality of clearing elements in the form of hydrodynamic flow profiles, and the third clearing zone comprises a plurality of clearing elements in the form of wedge-shaped elevations.

12. A screen clearer for a pressure screening apparatus comprising:

a substantially cylindrical body having a cylindrical outer surface;

the cylindrical outer surface comprising at least a first clearing zone and at least a second clearing zone, the first clearing zone having a plurality of clearing elements and the second clearing zone having a plurality of clearing elements which are different from those of the first clearing zone, a third clearing zone disposed adjacent the second clearing zone and a fourth clearing zone disposed adjacent the third clearing zone, wherein the third clearing zone comprising a plurality of clearing elements which are different from those of the first clearing zone and the second clearing zone and wherein the fourth clearing zone comprising a plurality of clearing elements which are different from those of the first, second, and third clearing zones, wherein the cylindrical body is rotatably mountable, and wherein each of the first clearing zone, the second clearing zone, the third clearing zone, and the fourth clearing zone comprises a modular section which are detachably coupled to each other.

13. A screen clearer for a pressure screening apparatus comprising:

a substantially cylindrical body having a cylindrical outer surface;

the cylindrical outer surface comprising at least a first clearing zone and at least a second clearing zone, the first clearing zone having a plurality of clearing elements and the second clearing zone having a plurality of clearing elements which are different from those of the first clearing zone, a third clearing zone disposed adjacent the second clearing zone and a fourth clearing zone disposed adjacent the third clearing zone, wherein the third clearing zone comprises a plurality of clearing elements which are different from those of the first clearing zone and the second clearing zone and wherein the fourth clearing zone comprising a plurality of clearing elements which are different from those of the first, second, and third clearing zones, wherein the cylindrical body is rotatably mountable, and wherein the first clearing zone comprises a plurality of clearing elements in the form of substantially spherical segments, the second clearing zone comprises a plurality of clearing elements in the form of hydrodynamic flow profiles, the third clearing zone comprises a plurality of clearing elements in the form of wedge-shaped elevations and the fourth clearing zone comprises one of a lobed rotor and rotating polygon having at least two lobes.

14. A pressure screening apparatus for screening a stock suspension comprising:

an inflow chamber;

a suspension inflow connected to one end of the inflow chamber;

a reject outflow connected to another end of the inflow chamber;

an accepted stock chamber;

an acceptance stock pipe connected to the accepted stock chamber;

a rotatable screen element disposed between the inflow chamber and the accepted stock chamber;

a rotatable screen clearer adapted to move with respect to the at least one screen element for preventing clogging of the at least one screen element;

the screen clearer comprising at least a first clearing zone for producing a first clearing effect and at least a second clearing zone for producing a second clearing effect, the first clearing effect being different from the second clearing effect, wherein the stock suspension flows into the inflow chamber via the suspension inflow such that a portion of the stock suspension flows through the clearing zones and exits through the reject outflow.

15. A pressure screening apparatus for screening a stock suspension comprising:

an inflow chamber;

a suspension inflow connected to one end of the inflow chamber;

a reject outflow connected to another end of the inflow chamber;

an accepted stock chamber;

an acceptance stock pipe connected to the accepted stock chamber;

at least one screen element disposed between the inflow chamber and the accepted stock chamber;

a screen clearer adapted to move with respect to the at least one screen element for preventing clogging of the at least one screen element;

the screen clearer comprising at least a first clearing zone for producing a first clearing effect and at least a second clearing zone for producing a second clearing effect, the first clearing effect being different from the second clearing effect;

the first clearing zone comprising a plurality of clearing elements in the form of hydrodynamic flow profiles;

the second clearing zone comprising a plurality of clearing elements in the form of wedge-shaped elevations, wherein the stock suspension flows into the inflow chamber via the suspension inflow such that a portion of the stock suspension flows through the first and second clearing zones and exits through the reject outflow.

16. The pressure screening apparatus of claim 15, wherein the at least one screen separates the inflow chamber from the accepted stock chamber.

17. The pressure screening apparatus of claim 15, wherein the second clearing zone produces a clearing effect which is greater than the first clearing zone.

18. The pressure screening apparatus of claim 15, wherein the second clearing zone produces a greater flow resistance than the first clearing zone.

19. The pressure screening apparatus of claim 15, wherein the plurality of clearing elements of at least one of the first zone and the second zone are fixed to a surface of the screen clearer.

20. The pressure screening apparatus of claim 15, wherein the surface of the screen clearer rotates with respect to the at least one screen element.

21. The pressure screening apparatus of claim 15, wherein the second clearing zone is axially separated from the first clearing zone.

22. The pressure screening apparatus of claim 15, wherein the hydrodynamic flow profiles are fixed to a surface of the screen clearer such that they are separated from the surface by a radial distance.

23. The pressure screening apparatus of claim 15, wherein the wedge-shaped elevations are fixed to a surface of the screen clearer.

24. The pressure screening apparatus of claim 15, wherein the at least one screen element is cylindrical.

25. The pressure screening apparatus of claim 15, wherein a force-through tendency of the second clearing zone is greater than a force-through tendency of the first clearing zone.

26. The pressure screening apparatus of claim 25, wherein the suspension travels from the first clearing zone to the second clearing zone in a transport flow path.

27. The pressure screening apparatus of claim 15, wherein the at least one screen element comprises a plurality of apertures of varying sizes.

28. The pressure screening apparatus of claim 27, wherein the apertures adjacent the first clearing zone are greater in size than the apertures adjacent the second clearing zone.

29. The pressure screening apparatus of claim 15, wherein the at least one screen element comprises one of apertures and slots and slits.

30. The pressure screening apparatus of claim 29, wherein the at least one screen element comprises slots.

31. The pressure screening apparatus of claim 30, wherein the slots adjacent the first zone have a width which is greater than the slots adjacent the second zone.

32. The pressure screening apparatus of claim 15, wherein the at least one screen element comprises round holes, such that the round holes adjacent the first clearing zone have a greater diameter than the round holes which are adjacent the second clearing zone.

33. The pressure screening apparatus of claim 32, wherein the at least one screen clearer comprises at least two modular sections which are detachably coupled together.

34. The pressure screening apparatus of claim 33, wherein at least one modular section comprises one of the first clearing zone and the second clearing zone.

35. The pressure screening apparatus of claim 34, wherein the first zone comprises a modular section and the second zone comprises a modular section.

36. The pressure screening apparatus of claim 35, wherein the modular sections are interchangeable.

37. A pressure screening apparatus for screening a stock suspension comprising:

an inflow chamber;

a suspension inflow connected to one end of the inflow chamber;

a reject outflow connected to another end of the inflow chamber;

an accepted stock chamber;

an acceptance stock pipe connected to the accepted stock chamber;

at least one screen element disposed between the inflow chamber and the accepted stock chamber;

a screen clearer adapted to move with respect to the at least one screen element for preventing clogging of the at least one screen element;

the screen clearer comprising at least a first clearing zone for producing a first clearing effect, at least a second clearing zone for producing a second clearing effect, and at least a third clearing zone for producing a third clearing effect, each of the first, second and third clearing effects being different from one another;

the first clearing zone comprising a plurality of clearing elements in the form of substantially spherical segments;

the second clearing zone comprising a plurality of clearing elements in the form of hydrodynamic flow profiles; and the third clearing zone comprising a plurality of clearing elements in the form of wedge-shaped elevations, wherein the stock suspension flows into the inflow chamber via the suspension inflow such that a portion of the stock suspension flows through the first and second clearing zones and exits through the reject outflow.

38. The pressure screening apparatus of claim 37, wherein the first clearing zone is disposed adjacent the suspension inflow.

39. The pressure screening apparatus of claim 38, wherein the second clearing zone is disposed adjacent the first clearing zone.

40. The pressure screening apparatus of claim 39, further comprising a fourth clearing zone disposed adjacent the third clearing zone, wherein the fourth clearing zone is arranged to produce a different clearing effect than the first, second, and third clearing zones.

41. The pressure screening apparatus of claim 40, wherein the fourth clearing zone comprises a polygon having at least two lobes.

42. The pressure screening apparatus of claim 40, wherein the fourth clearing zone is disposed adjacent the reject outflow.

43. The pressure screening apparatus of claim 40, wherein the clearing effect increases from the first clearing zone disposed adjacent the suspension inflow to the fourth clearing zone disposed adjacent the reject outflow.

44. The pressure screening apparatus of claim 37, wherein the at least one screen element comprises a plurality of apertures of varying sizes.

45. The pressure screening apparatus of claim 44, wherein the apertures adjacent at least the first clearing zone are greater in size than the apertures adjacent at least one of the second and third clearing zones.

46. The pressure screening apparatus of claim 37, wherein the at least one screen element comprises one of apertures and slots and slits.

47. The pressure screening apparatus of claim 46, wherein the at least one screen element comprises slots.

48. The pressure screening apparatus of claim 47, wherein the slots adjacent the first zone have a width which is greater than the slots adjacent at least one of the second and third zones.

49. The pressure screening apparatus of claim 37, wherein the at least one screen element comprises round holes, such that the round holes adjacent the first clearing zone have a greater diameter than the round holes which are adjacent at least one of the second and third clearing zone.

50. The pressure screening apparatus of claim 37, wherein the at least one screen clearer comprises at least three modular sections which are detachably coupled together.

51. The pressure screening apparatus of claim 50, wherein at least one modular section comprises one of the first, the second, and the third clearing zones.

52. The pressure screening apparatus of claim 51, wherein each of the first, second, and third zones comprise a modular section.

53. The pressure screening apparatus of claim 52, wherein the modular sections are interchangeable.

54. A screen clearer for a pressure screening apparatus comprising:

a substantially cylindrical body having a cylindrical outer surface;

the cylindrical outer surface comprising at least a first clearing zone and at least a second clearing zone;

the first clearing zone comprising a plurality of clearing elements in the form of hydrodynamic flow profiles;

the second clearing zone comprising a plurality of clearing elements in the form of wedge-shaped elevations, wherein the cylindrical body is rotatably mountable.

55. The screen clearer of claim 54, wherein the first clearing zone comprises a modular section which is detachably coupled to the second clearing zone.

56. The screen clearer of claim 54, wherein each of the first clearing zone and the second clearing zone comprises a modular section which are detachably coupled to each other.

57. The screen clearer claim 54, further comprising a third clearing zone disposed adjacent the second clearing zone, the third clearing zone comprising a plurality of clearing elements which are different from those of the first clearing zone and the second clearing zone.

58. The screen clearer of claim 54, wherein each of the first clearing zone, the second clearing zone, and the third clearing zone comprises a modular section which are detachably coupled to each other.

59. The screen clearer claim 54, further comprising a third clearing zone disposed adjacent the second clearing zone and a fourth clearing zone disposed adjacent the third clearing zone, wherein the third clearing zone comprising a plurality of clearing elements which are different from those of the first clearing zone and the second clearing zone and wherein the fourth clearing zone comprises a plurality of clearing elements which are different from those of the first, second, and third clearing zones.

60. The screen clearer of claim 59, wherein each of the first clearing zone, the second clearing zone, the third clearing zone, and the fourth clearing zone comprises a modular section which are detachably coupled to each other.

61. The screen clearer of claim 59, wherein the first clearing zone comprises a plurality of clearing elements in the form of substantially spherical segments, the second clearing zone comprises a plurality of clearing elements in the form of hydrodynamic flow profiles, the third clearing zone comprises a plurality of clearing elements in the form of wedge-shaped elevations and the fourth clearing zone comprises one of a lobed rotor and rotating polygon having at least two lobes.

62. A screen clearer for a pressure screening apparatus comprising:

a substantially cylindrical body having a cylindrical outer surface;

the cylindrical outer surface comprising at least a first clearing zone, at least a second clearing zone, and at least a third clearing zone;

the first clearing zone comprising a plurality of clearing elements in the form of substantially spherical segments;

the second clearing zone comprising a plurality of clearing elements in the form of hydrodynamic flow profiles; and the third clearing zone comprising a plurality of clearing elements in the form of wedge-shaped elevations, wherein the cylindrical body is rotatably mountable.

63. The screen clearer of claim 62, wherein the first clearing zone comprises a modular section which is detachably coupled to the second clearing zone.

64. The screen clearer of claim 62, wherein each of the first clearing zone, the second clearing zone, and the third clearing zone comprises a modular section which are detachably coupled to each other.

65. The screen clearer claim 62, further comprising a fourth clearing zone disposed adjacent the third clearing zone, wherein the fourth clearing zone comprises a plurality of clearing elements which are different from those of the first, second, and third clearing zones.

66. The screen clearer of claim 65, wherein each of the first clearing zone, the second clearing zone, the third clearing zone, and the fourth clearing zone comprises a modular section which are detachably coupled to each other.

67. The screen clearer of claim 65, wherein the fourth clearing zone comprises one of a lobed rotor and rotating polygon having at least two lobes.

* * * * *